US005502900A

United States Patent [19]

Hui

[11] Patent Number: 5,502,900

[45] Date of Patent: Apr. 2, 1996

[54] DISH DRIER

[76] Inventor: Chao M. Hui, P.O. Box 82-144, Taipei, Taiwan

[21] Appl. No.: 444,304

[22] Filed: May 18, 1995

[51] Int. Cl.[6] ..... F26B 19/00

[52] U.S. Cl. ..... 34/202; 34/218; 34/238; 34/389

[58] Field of Search ..... 34/202, 389, 238, 34/218, 232, 224, 105, 104

[56] References Cited

U.S. PATENT DOCUMENTS

| | | | |
|---|---|---|---|
| 3,650,039 | 3/1972 | Haeding | 34/218 |
| 3,820,251 | 6/1974 | Abernathy | 34/218 |
| 4,043,048 | 8/1977 | Veater | 34/202 |
| 4,318,749 | 3/1982 | Mayer | 34/218 |
| 4,625,432 | 12/1986 | Baltes | 34/202 |
| 5,363,967 | 11/1994 | Kawano et al. | 34/218 |

*Primary Examiner*—John T. Kwon
*Attorney, Agent, or Firm*—Alfred Lei

[57] ABSTRACT

A dish drier including a housing having an inner vertical wall, an outer vertical wall, the inner vertical wall being provided with a plurality of rails, a plurality of racks supported on the rails, a groove formed between the inner vertical wall and the outer vertical wall, two doors slidably fitted in the groove, a recess formed at a lower portion, and a receptacle received in the recess, a container mounted on a top of the housing, a steam generator installed in the container, a hot air blower arranged in the container, a first inverted U-shaped member mounted on an inner vertical wall of the housing, having a plurality of perforations, and connected with the steam generator, and a second inverted U-shaped member mounted on an inner vertical wall of the housing, having a plurality of perforations, and connected with the hot air blower.

1 Claim, 5 Drawing Sheets

DISH DRIER

BACKGROUND OF THE INVENTION

1. Field of the Invention

This invention relates to an improved dish drier.

2. Description of the Prior Art

It has been found that the conventional dish drier is simply a container which is provided with a heating element at the bottom thereof. However, such a dish drier must take a long period of time to dry the dishes and cannot be used for sterilizing the dishes. Furthermore, the water dripping down from the dishes may even cause electric leakage thereby resulting accidents.

Therefore, it is an object of the present invention to provide a dish drier which can obviate and mitigate the above-mentioned drawbacks.

SUMMARY OF THE INVENTION

This invention relates to an improved dish drier.

It is the primary object of the present invention to provide a dish drier which utilizes steam to sterilize the dish.

It is another object of the present invention to provide a dish drier which is safe in use.

It is still another object of the present invention to provide a dish drier which is simple in construction.

It is still another object of the present invention to provide a dish drier which is easy to manufacture.

It is a further object of the present invention to provide a dish drier which is low in cost.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
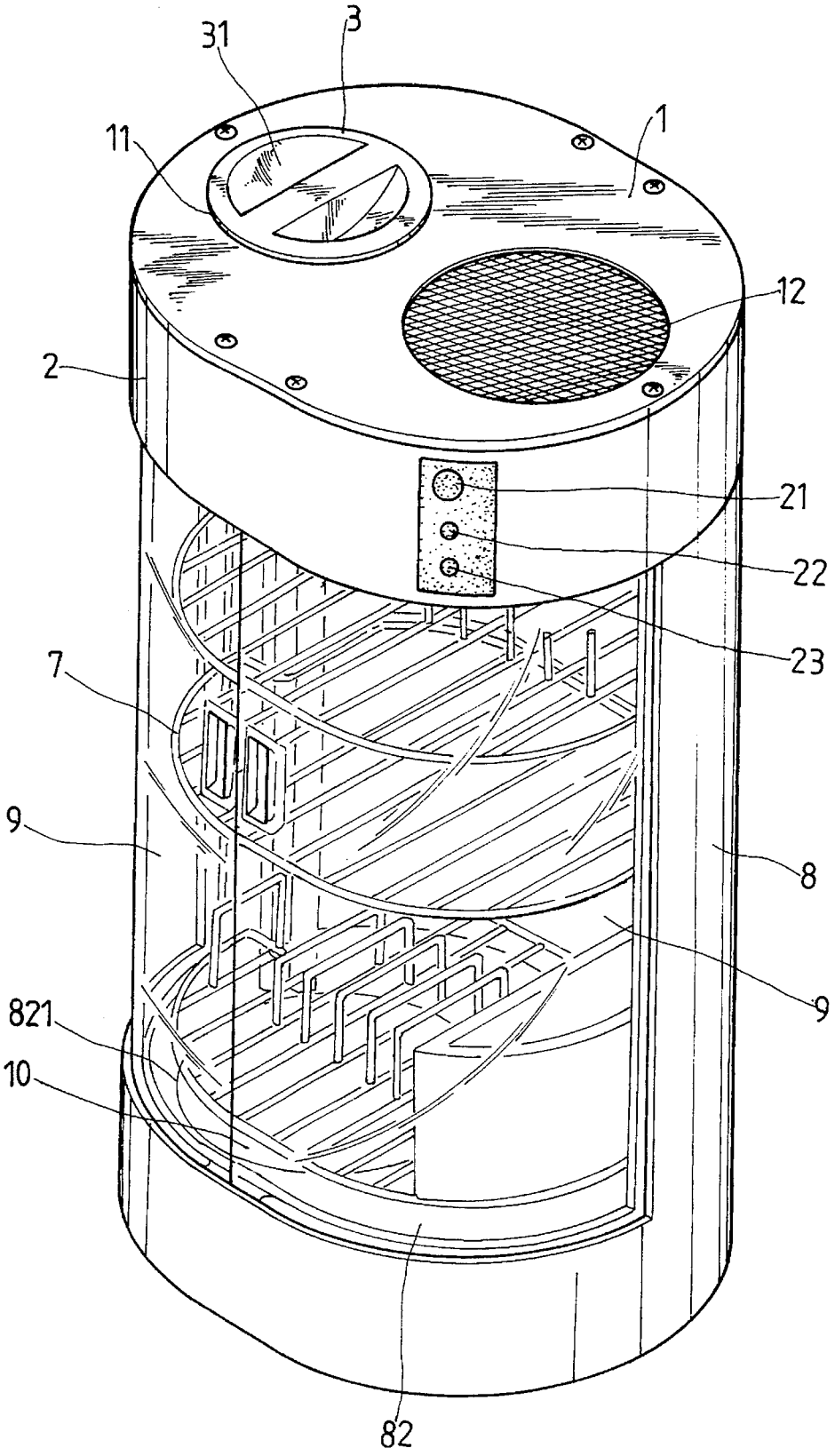
FIG. 1 is a perspective view of a dish drier according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
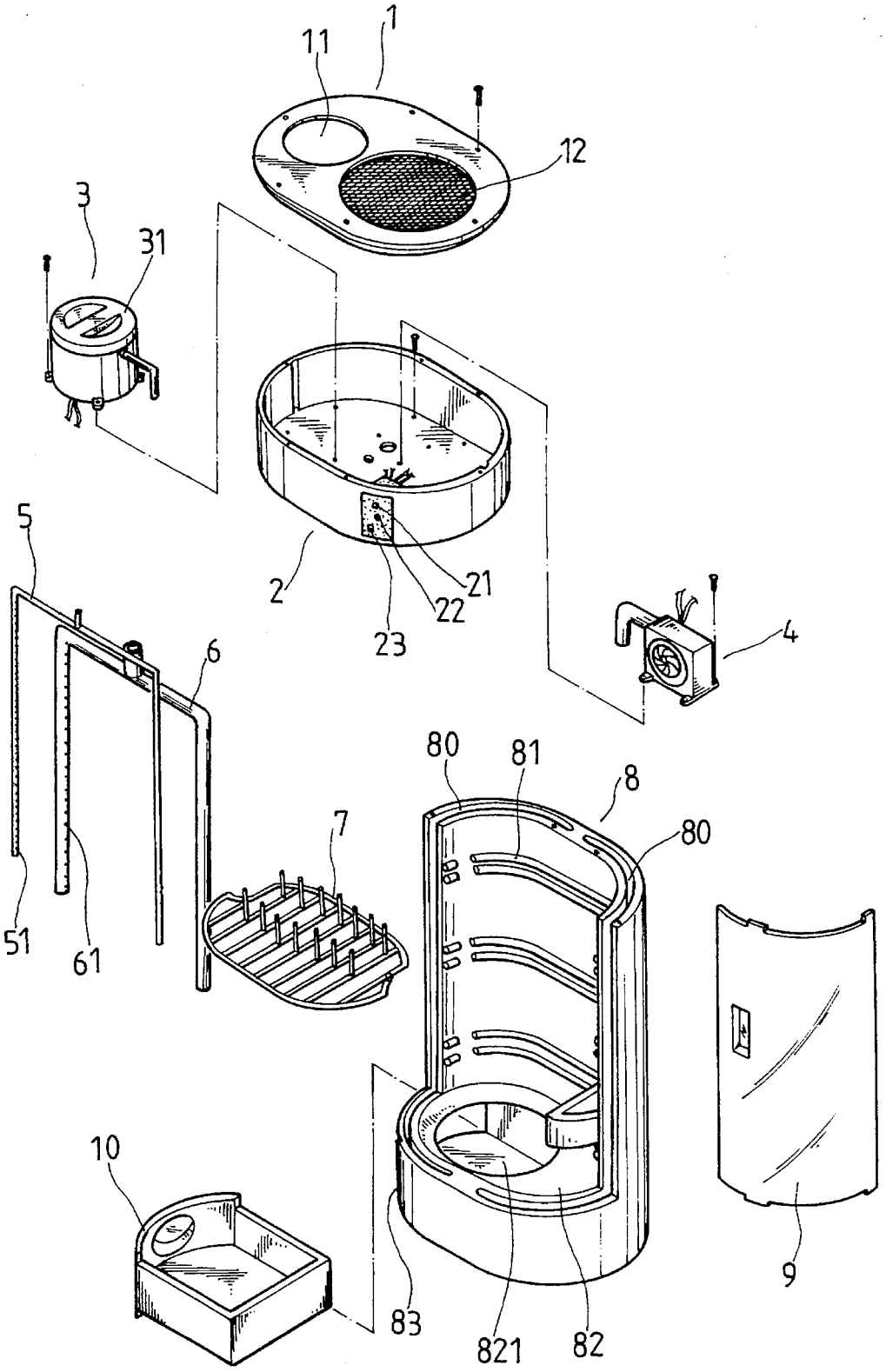
FIG. 2 is an exploded view of the dish drier.
Figure 3:
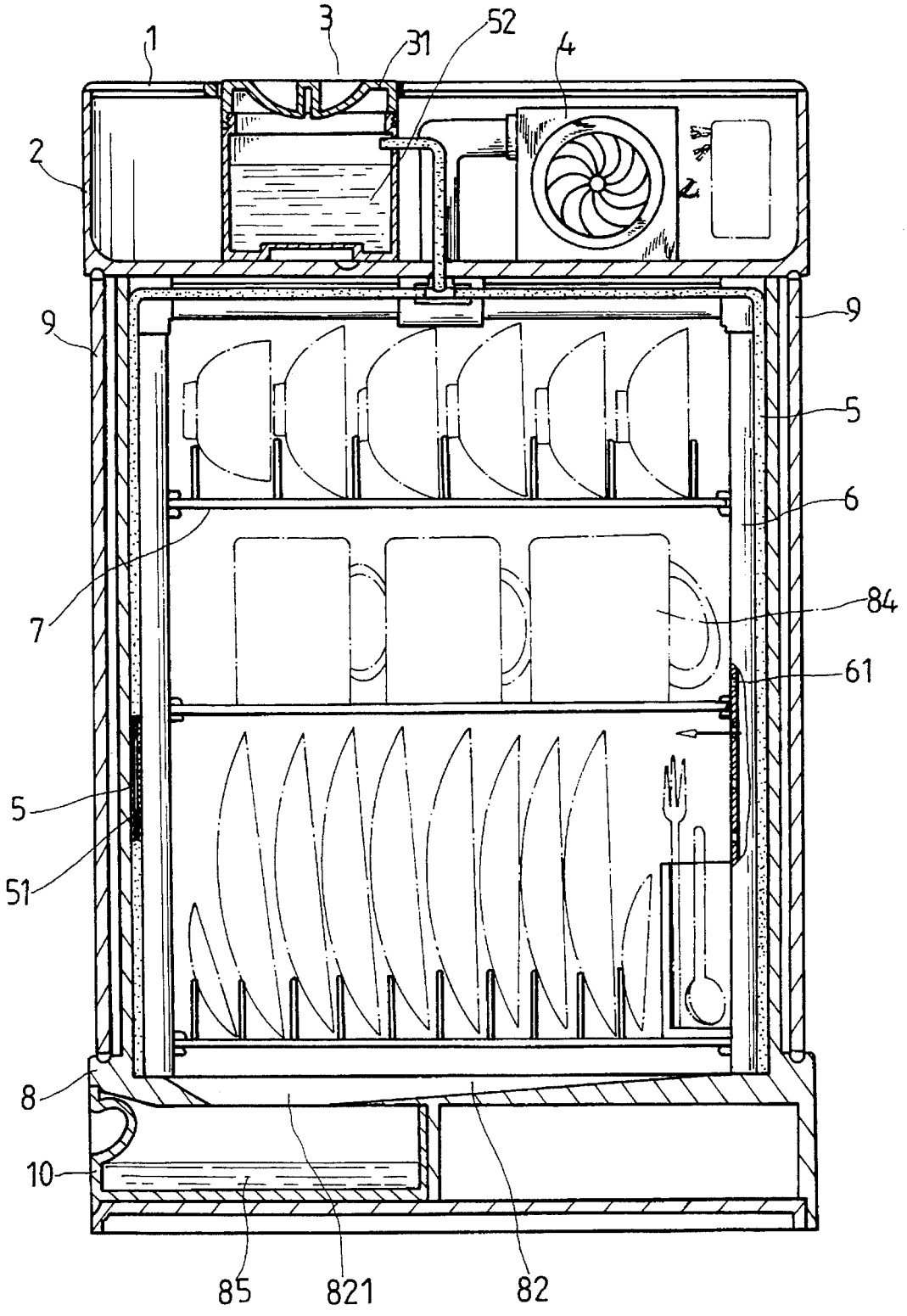
FIG. 3 is a sectional view of the dish drier.
Figure 4:
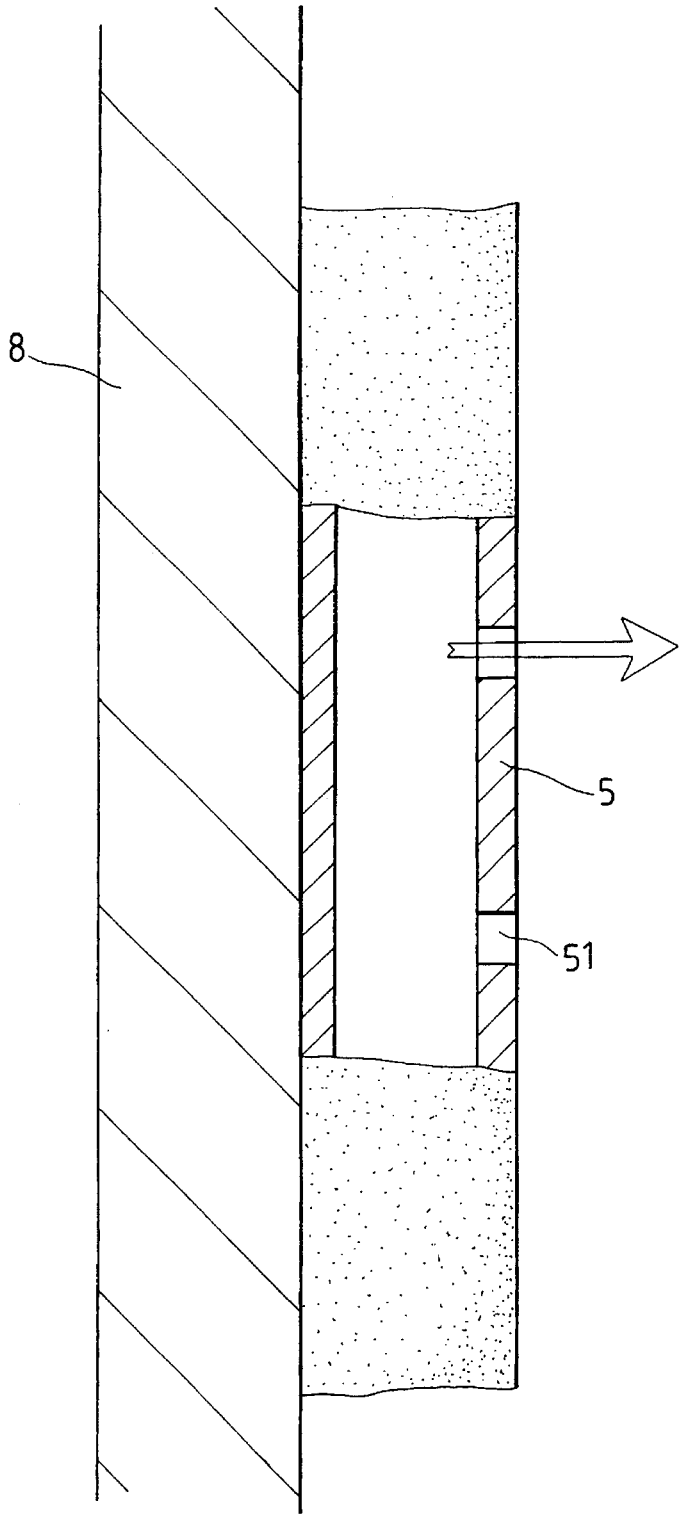
FIG. 4 is a sectional view showing the structure of the first inverted U-shaped member.
Figure 6:
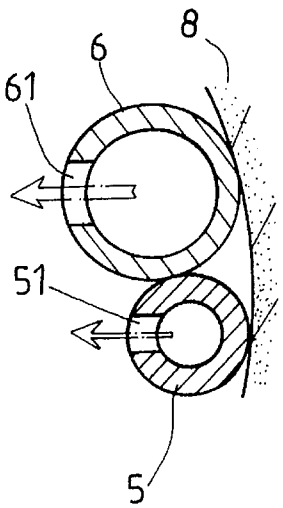
FIG. 6 is a sectional view showing the arrangement of the first and second inverted U-shaped members.
Figure 5:
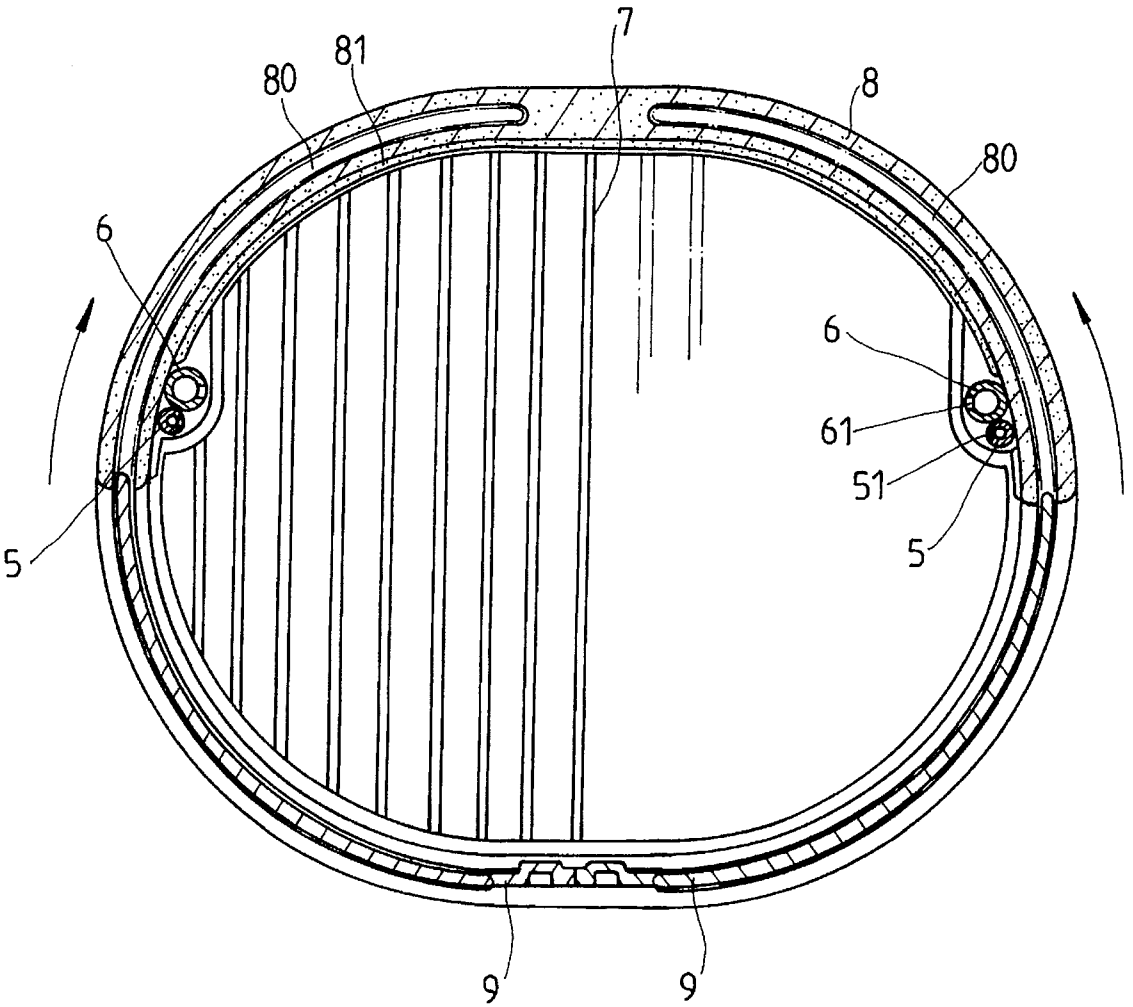
FIG. 5 is a cross sectional view of the dish drier.

With reference to the drawings and in particular to FIGS. 1 and 2 thereof, the dish drier according to the present invention comprises a housing 8. A container 2 is mounted on the top of the housing 8, in which are fitted a steam generator 3 and a hot air blower 4. The steam generator 3 and the hot air blower 4 may be of any conventional design well to those skilled in the art and are not considered a part of the invention. The steam generator 3 includes a holder for receiving water 52 (see FIG. 3) which is provided with a cover 31. The container 2 is provided at the top with a covering plate 1 which has a first opening 11 for enabling the cover 31 to be removed and a second opening for mounting a net 12. The net 12 is just located above the hot air blower 4. The container 2 is provided with a control panel on which are mounted a switch 21, a steam indicating light 22, and a drying indicating light 23. The switch 21, the steam indicating light 22 and the drying indicating light 23 are electrically connected with the steam generator 3 and the hot air blower 4 by well known means which is not considered a part of the invention. A first inverted U-shaped member 5 formed with a plurality of perforations 51 is arranged on the inner vertical wall of the housing 8 and connected with the steam generator 3 (see FIGS. 4, 5 and 6). A second inverted U-shaped member 6 formed with a plurality of perforations 61 is arranged on the inner vertical wall of the housing 8 and connected with the hot air blower 4 (see FIGS. 4, 5 and 6). The housing 8 is formed with a groove 80 between its outer vertical wall and inner vertical wall adapted to receive two movable doors 9. The inner vertical wall of the housing 8 is provided with a plurality of rails 81 for mounting a plurality of racks 7 for supporting dishes 84 (see FIG. 3). The inner bottom of the housing 8 has a convergent surface 82 formed with an opening 821 so that the water 85 dropping down from the dishes 84 can be collected in a receptacle 10 which is received in a recess 83 formed at the lower portion of the housing 8. The water 85 can be conveniently poured out from the receptacle 10.

When in use, the steam generator 3 will produce steam which will be discharged into the housing through the perforations 51 of the first inverted U-shaped member 5. In the meantime, the hot air blower 4 will blow hot air into the housing. Hence, the dishes in the housing 8 will be sterilized and dried rapidly. In addition, the water dropping from the dishes 84 will be collected in the receptacle 10.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A dish drier comprising:

a housing having an inner vertical wall, an outer vertical wall, said inner vertical wall being provided with a plurality of rails, a plurality of racks supported on the rails, a groove formed between the inner vertical wall and the outer vertical wall, two doors slidably fitted in the groove, a recess formed at a lower portion, a receptacle received in the recess, and an inner bottom formed with a convergent surface having an opening in communication with said recess;

a container mounted on a top of said housing;

a steam generator installed in said container;

a hot air blower arranged in said container;

a first inverted U-shaped member mounted on an inner wall of said housing, having a plurality of perforations, and connected with said steam generator; and a second inverted U-shaped member mounted on an inner wall of said housing, having a plurality of perforations, and connected with said hot air blower.

* * * * *